US008409064B2

(12) United States Patent
Desertot et al.

(10) Patent No.: US 8,409,064 B2
(45) Date of Patent: Apr. 2, 2013

(54) METHOD AND DEVICE FOR MAKING BOXES FROM A SET OF BLANKS

(75) Inventors: Didier Desertot, Arc sur Tille (FR); Thierry Colas, Quetigny (FR); Eric Schuster, Thorey en Plaine (FR); Gerard Mathieu, Cergy (FR)

(73) Assignee: Otor Societe Anonyme, Puteaux (FR)

( * ) Notice: Subject to any disclaimer, the term of this patent is extended or adjusted under 35 U.S.C. 154(b) by 385 days.

(21) Appl. No.: 12/865,791

(22) PCT Filed: Feb. 3, 2009

(86) PCT No.: PCT/FR2009/000122

§ 371 (c)(1),
(2), (4) Date: Oct. 21, 2010

(87) PCT Pub. No.: WO2009/112707

PCT Pub. Date: Sep. 17, 2009

(65) Prior Publication Data

US 2011/0053746 A1 Mar. 3, 2011

(30) Foreign Application Priority Data

Feb. 4, 2008 (FR) ..... 08 00602

(51) Int. Cl.
*B31B 1/06* (2006.01)
*B31B 1/62* (2006.01)

(52) U.S. Cl. ..... 493/125; 493/120; 493/114; 493/122; 493/126; 493/128; 493/130; 493/141; 493/147; 493/379; 493/383

(58) Field of Classification Search ..... 493/84, 493/102, 104, 114, 120–123, 125–128, 130–131, 493/141, 147, 152–153, 162, 175, 374, 379, 493/383, 393

See application file for complete search history.

(56) References Cited

U.S. PATENT DOCUMENTS 4,283,188 A * 8/1981 Wingerter et al. ..... 493/89
4,518,379 A * 5/1985 Eldridge ..... 493/334
4,549,878 A * 10/1985 Herrin et al. ..... 493/334

(Continued)

FOREIGN PATENT DOCUMENTS

WO 2007/116150 A 10/2007

OTHER PUBLICATIONS

International Search Report for PCT/FR2009/000122 dated Jul. 21, 2009.

*Primary Examiner* — Christopher Harmon
(74) *Attorney, Agent, or Firm* — Banner & Witcoff, Ltd.

(57) ABSTRACT

This is a method and device for making a packaging box from two blanks (2, 3), wherein blanks are taken simultaneously from two adjacent stacks (25, 26) and placed on two parallel tracks (29, 30), the blanks are transferred flat until butted longitudinally to an assembly station, the first blank is glued on its way to the longitudinal abutment position, the first and second blanks are butted laterally into their respective positions to give them an exact lateral reference position, they are grasped, and transferred laterally, and the second blank is placed on the first blank which is thus indexed, escaping the drivers (61) of the first track (29) when the second blank is placed against the fast blank, but clamped by vertical pressure. The second blank is then applied to the first blank to glue them together in their respective defined longitudinal positions, and the resulting set of blanks is then transferred to an erecting station where the box is erected by rolling the blanks around a core.

18 Claims, 9 Drawing Sheets

U.S. PATENT DOCUMENTS 4,650,448 A * 3/1987 Urso ..... 493/18
4,798,571 A * 1/1989 Everman et al. ..... 493/114
4,932,930 A * 6/1990 Coalier et al. ..... 493/128
5,100,369 A * 3/1992 Keeler ..... 493/87
5,224,919 A * 7/1993 Walsh ..... 493/89
5,495,703 A * 3/1996 Kruit et al. ..... 53/398
6,312,369 B1 * 11/2001 Plemons et al. ..... 493/84
2004/0214704 A1 10/2004 Gardner

* cited by examiner

METHOD AND DEVICE FOR MAKING BOXES FROM A SET OF BLANKS

The present invention relates to a method for producing a packaging box with a polygonal section from at least two blanks of sheet cardboard or corrugated cardboard material, namely a first blank forming the bottom of the box and a second blank comprising at least four panels connected together by parallel fold lines, forming the cover of the box.

It also relates to a device for producing such packaging box.

It finds a particularly important, although not exclusive, application in the field of corrugated cardboard reinforced boxes and in the field of corrugated cardboard boxes or packages that are ready for sale, that is to say intended to at least partially remain in supermarket shelf spaces.

Methods and devices for manufacturing two-part packaging obtained from two flongs or blanks are already known.

These two-part packages allow subsequent separation, one portion of the package then remaining as a display case.

Therefore a system is known consisting in wrapping a first blank around a core, then, after gluing, a second blank which is then wrapped onto the first blank.

Such a two-stage wrapping on the core is complicated and cannot be carried out at a high rate (higher than twenty boxes per minute).

Another solution consists in gluing the two blanks to one another before wrapping, the second blank being placed directly on the first blank from a higher magazine.

The use of such a magazine requires an extremely precise placement device incompatible with high production rates and requires fine adjustments, hence the obligatory use of a system of cams and arms necessary for perfect repetitiveness and therefore slower.

The present invention makes it possible to alleviate these drawbacks.

Specifically, its object is to provide a method and a device for making packages which satisfy better than those previously known the requirements of the practice notably in that it allows an efficient and rapid build-up in automatic production of the boxes at extremely fast rates, higher than forty strokes per minute, rising to the order of fifty stokes per minute which has never been achieved hitherto with two-part packages.

With the method and the device according to the invention, the boxes obtained have great rigidity and excellent resistance to compression and destruction.

The method and the device according to the invention therefore satisfy the requirement of the high-volume retail trade which has been seeking for many years methods of manufacturing packages that can be placed directly on the shelves of displays and allow a good pick-up of the product, from conventional blanks, and to do so in a simple manner without requiring steps of application that are too awkward.

It is therefore possible to obtain a package that does not require sophisticated blanks and/or particular glue, and to do so while maintaining high production rates even with low basis weights.

The invention exhibits particularly advantageous results with blanks in which the lower portion of the fold lines of the second blank is cut and/or squashed in order to make the subsequent wrapping easier without sliding on the first blank.

But other blanks may also be envisaged as will be seen below.

For this purpose, invention proposes notably a method for producing a packaging box with a polygonal section from at least two blanks of sheet cardboard or corrugated cardboard material, namely a first blank forming the bottom of said box, and a second blank comprising at least four panels respectively connected together by third parallel fold lines, comprising a lower free edge lacking a flap on the side of the bottom, said second blank forming a cover for said box, characterized in that blanks are taken simultaneously from two adjacent magazines and said blanks are placed on two parallel tracks, namely a first track for the first blank and a second track for the second blank, said blanks are transferred flat to said tracks by being guided substantially with a lateral clearance between two rails by a stopper-drive system, until they butt longitudinally at an assembly station, in a determined longitudinal position for each of the blanks, said first blank is glued during its transfer to its longitudinal abutment position, the first and second blanks are wedged in lateral abutment respectively in order to be given an exact lateral reference position, the second blank is picked up, transferred laterally and placed on the first blank thus indexed, by escaping the stoppers of the first track when the second blank is placed beside the first, while being held by vertical-pressure immobilization, the second blank is then pressed onto the first blank in order to glue them together in their determined respective longitudinal positions, and then the assembly of blanks thus formed is transferred to a forming station where the box is formed by rolling the blanks around a core.

In particular embodiments, use is also made of one and/or the other of the following arrangements:

- in order to escape the stoppers of the first track, the first blank is raised above said stoppers;
- in order to escape the stoppers of the first track, said stoppers are retracted downward;
- in order to retract the stoppers of the first track, the drive stoppers of said first blank are pivoted about a shaft situated above the plane of the first track.

Such an arrangement allows them to be released without catching the cardboard;

- the vertical-pressure immobilization of the first blank is carried out by means of a stopper beveled toward the blanks which is actuated vertically;
- the second blank is brought onto the first blank by transverse translation, after being picked up by suction cups actuated vertically by linear electric motor cylinders, at a speed of translation of between 4 m/s and 6 m/s;
- the second blank is transferred to the first blank by an assembly of two carriages actuated by a mobile belt-clamping drive system;
- in order to transfer the set of blanks thus formed to the forming station, said set is lifted in order to bring it into contact with pick-up suction cups of an assembly for transferring the set to the forming station;
- the first blank comprising a series of at least four main sections terminated by a fastening tab, said sections being connected together by first fold lines that are parallel with one another, said series of sections forming the outer walls of the base of the box, comprising on one side an upper free edge lacking a flap and being connected on the other side to a series of flaps by second fold lines perpendicular to said first fold lines, the second blank is placed on the first blank by aligning or by substantially aligning the free edge of the second blank with the second fold lines of the first blank and by superposing the third fold lines relative to the first fold lines of the first blank;

the first blank comprising a central panel and four lateral peripheral flaps, one of said flaps, previously covered with adhesive, is placed facing a section of the second blank in order to form, once folded around the core, a tray-shaped bottom.

The invention also proposes a device making it possible to apply the method as described above.

It also relates more particularly to a device for producing a polygonal-section packaging box from at least two blanks made of sheet cardboard or corrugated cardboard material, namely a first blank forming the bottom of said box, and a second blank comprising at least four panels respectively connected together by third parallel fold lines, comprising a lower free edge lacking a flap on the side of the bottom, said second blank forming a cover for said box, characterized in that it comprises two adjacent storage magazines respectively of the first and second blanks, means for transferring said blanks to an assembly station comprising:

means for picking up the blanks from said magazines, two parallel tracks for transferring flat said blanks to an assembly station, namely a first track for the first blank and a second track for the second blank, each track comprising a stopper-drive system, means for guiding each of said blanks, each comprising two rails for guiding the blanks substantially with a lateral clearance up to the assembly station, and means for longitudinal abutment at said assembly station, in a determined longitudinal position for each of the blanks, means for coating the first blank with adhesive during its transfer to its longitudinal position, means for wedging in lateral abutment the first and second blanks in order to give them a respective exact lateral reference position against one of the rails, means for pick-up and lateral transfer by suction cups of the second blank in order to place it on the first blank thus indexed, in their determined respective longitudinal and lateral positions, means for escaping from the stoppers of the first track relative to the first blank, when the second blank is placed beside the first, and means for vertical-pressure immobilization of said first blank during the escape, means for pressing the second blank onto the first blank, and means for transferring the set of blanks thus formed to a forming station.

Advantageously, the device also comprises a forming station comprising a core and means for rolling the blanks around the core in order to form the box.

In an advantageou escape are means for retracting the stoppers downward.

In another embodiment, the means of escape from the stoppers are means arranged in order to lift the blank over said stoppers.

Equally advantageously, the means for vertical-pressure immobilization of the first blank comprise a stopper beveled toward the blanks which is actuated by a cylinder.

In one advantageous embodiment, the means for retracting the stoppers downward comprise means for pivoting the latter about a shaft situated above the plane of the first track, which allows a disengagement without catching the cardboard.

Advantageously, the means for picking up and transferring the second blank onto the first blank comprise pick-up means by suction cups actuated vertically by cylinders with a linear electric motor at a speed of translation of between 4 m/s and 6 m/s. This causes accelerations that can reach and/or exceed 7 g.

Also advantageously, the device described above is characterized in that, the first blank comprising a series of at least four main sections terminated by a fastening tab, said sections being connected together by first fold lines parallel with one another, said series of sections forming the outer walls of the base of the box and being connected on one side to a series of flaps by second fold lines perpendicular to said first fold lines, the pick-up and transfer means are arranged in order to place the third fold lines of the second blank substantially in line with the first fold lines of the first blank, and in that the meant for pressing the second blank onto the first are arranged in order to glue the two panels to the two facing nonadjacent sections.

The invention will be better understood in the light of the following description of the embodiments given below as nonlimiting examples.

It refers to the drawings accompanying it in which:

FIG. 1 gives a view in perspective of a set of first and second blanks that can be used with the invention.

Figure 1:
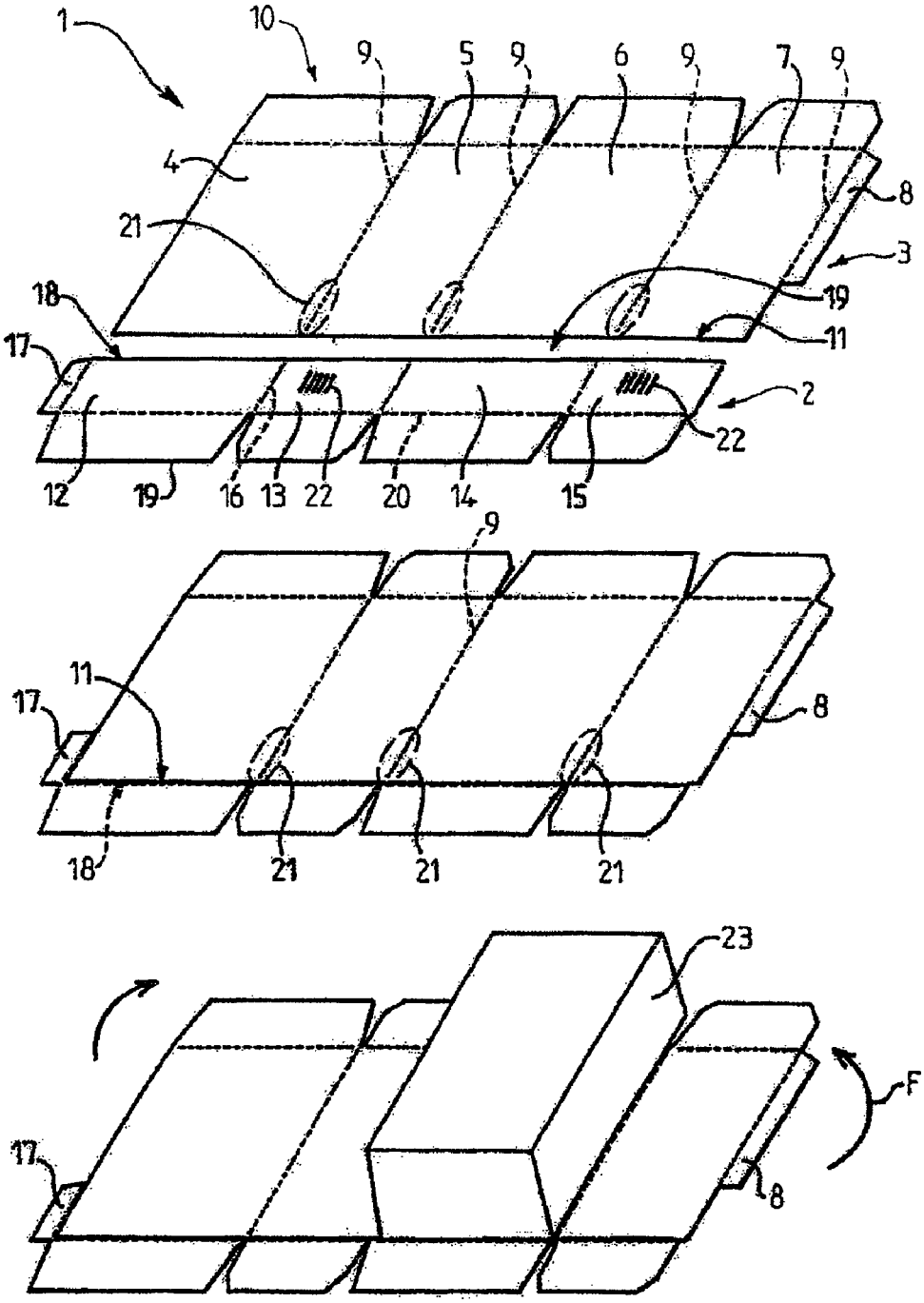
FIG. 1 shows a set of blanks 1 that can be used in a more particularly advantageous manner with the invention.

It comprises a first blank 2 forming the bottom of the box and a second blank 3 comprising four rectangular panels 4, 5, 6, 7 and a gluing tab 8, connected together by third parallel fold lines 9.

The second blank 3 comprises on one side a set of rectangular flaps 10 intended to form the top of the box, once the latter is produced, by gluing them to one another after filling, and comprises a free edge 11 on the other side, lacking a flap, in a manner known per se.

The first blank 2, suitable for forming a belt designed to constitute a display-case bottom, comprises four main rectangular sections 12, 13, 14, 15 forming the outer walls of the base of the box. They are connected together by first fold lines 16 parallel with one another, and are terminated, at the end opposite to the tab 8 of the second blank, by a gluing tab 17.

The sequence of sections comprises a free edge 18 on the side of the second blank, and a series of rectangular flaps 19 on the opposite side connected to said sections by second fold lines 20 perpendicular to the first lines 16.

The first fold lines 16 and the third fold lines 9 are, when the two blanks are to be placed facing one another in order to be glued to one another, substantially aligned.

"Substantially aligned" means any embodiment which will allow a subsequent wrapping the blank around a core, that is by virtue of the presence of notches in the bottom portion of the second blank, either because of an offset between first fold line and third fold line, an offset that increases in size gradually as the wrapping progresses, in order to confirm the making up for the clearances of the outer blank relative to the inner blank, or in a more advantageous embodiment of the invention allowing the highest production rates, by a precise superposition, in which case at least two out of three of the third fold lines of the second blank are in the bottom portion 21 cut or crushed facing the corresponding first fold line.

"Cut portion" means a portion incised or split through for example by a cutting blade or knife, from one side to the other, without removing material, or in one embodiment substantially without removal of material (that is to say with a slot less than one or two millimeters wide), unlike the notches of the prior art.

"Crushing" means crumpling of the grooving of the fold line.

One embodiment in which the fold lines are slightly offset from one another in order to allow a stacking of the sides during the wrapping around the core with the possibility of sliding one blank relative to the other is also possible.

However, and as indicated above, it is curiously more advantageous with the method and the device according to the invention to use two blanks in which the fold lines are superposed in the bottom portion 21 of the fold lines 9 relative to the lines 16, that is with crumpling over the height of the line 16 or over a slightly greater height, or with blank optionally offset slightly laterally relative to the fold line of the first facing blank, but still over the height, from a value corresponding to the minimum to the total value of the thicknesses of the papers (and not of the cardboard) forming the flongs, that is to say very little since of a value less than of the order of 1 or 2 mm or for example of 0.5 to 0.7 mm between groovings.

The other side 18 of the first blank is, for its part, lacking a flap.

Two of the sections, for example the intermediate section 13 and the end section 15, are, for their part, coated with adhesive, for example by lines for coating with the sowcalled "hotmelt" glue 22, in a manner known per se.

In the embodiment more particularly described of the packages that can be used with the invention, a gluing will be used that prevents the relative movement of the blanks in relation to one another, by virtue of the method of superposition more particularly described above that is favorable to high production rates.

Note that gluing preventing relative movement should be understood to be gluing preventing movement in the direction of the plane of the sections and panels without tearing and separation.

On the other hand, such a gluing will allow a subsequent separation of the elements of the box thus formed by transverse tearing of one relative to the other manually in order to release the cover from the base forming the display case.

With the invention, it is possible to use blanks made of corrugated cardboard for example from 2 to 3 mm thick, but this method surprisingly, and thanks to the combination of the steps that is uses, allows the use of cardboard that is thin and of low basis weight, for example less than 100 gr.

With reference to FIG. 1, it can subsequently be seen that (second diagram of the figure) the second blank 3 is, after the sections 13 and 15 are coated with adhesive, pressed onto the first blank while aligning the free edges 11 and 18 and superposing the zones 21 with the first fold lines 16, then brought under the core 23 in order to be subsequently wrapped (arrow F) before the gluing tabs 8 and 17, themselves previously coated with adhesive, are folded down successively over the opposite outer face of the panel to the adjacent section in order to allow the final formation of the box, the bottom of the tab 8 being cut out in order to allow the tab 17 to pass through.

Figure 2:
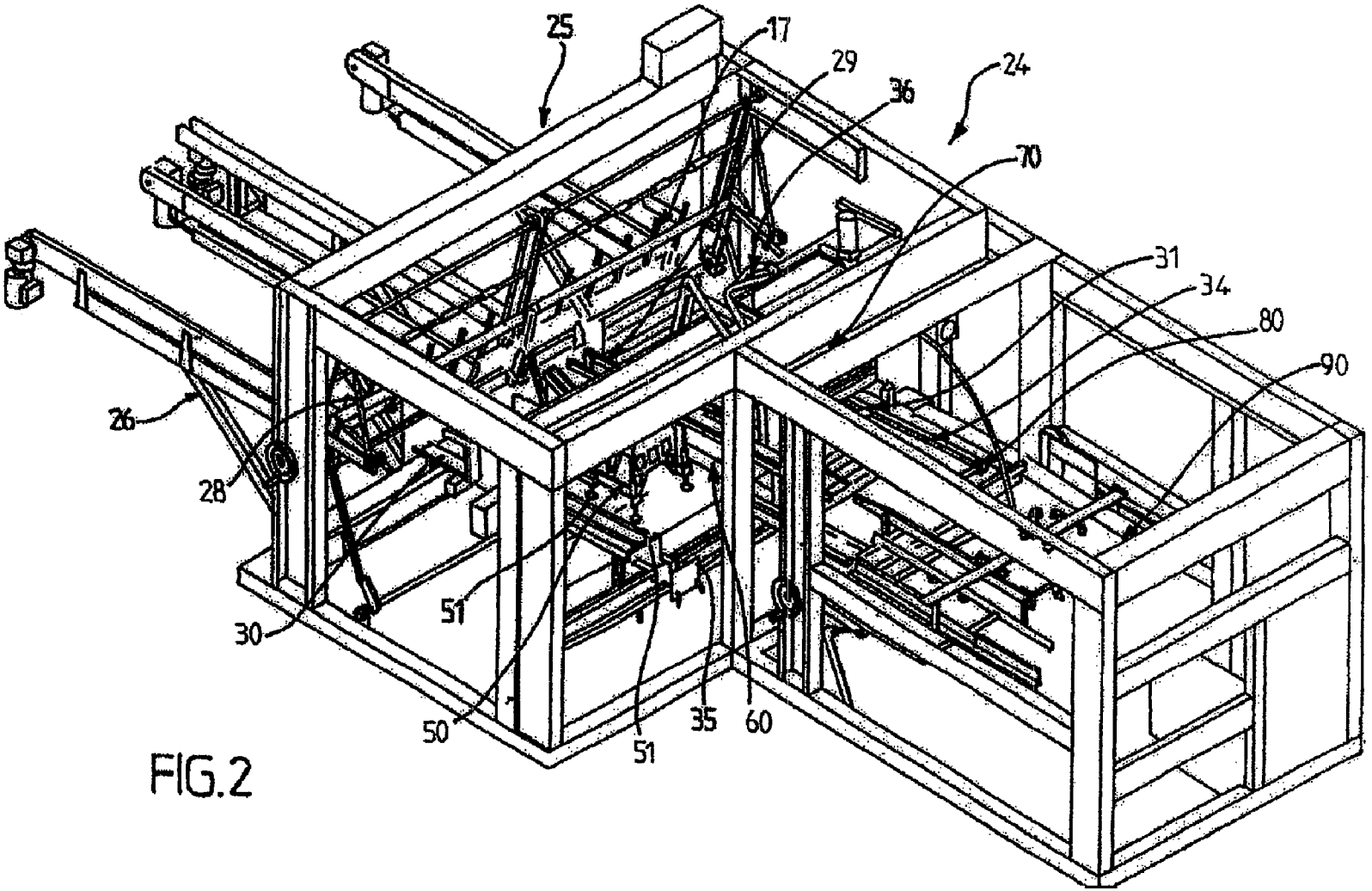
FIG. 2 is a general diagram in perspective of a device using the method according to one embodiment of the invention.

A device 24 according to the invention will now be described with reference to FIG. 2 and following.

Hereinafter, the same reference numbers will be used to designate the same elements.

Figure 5:
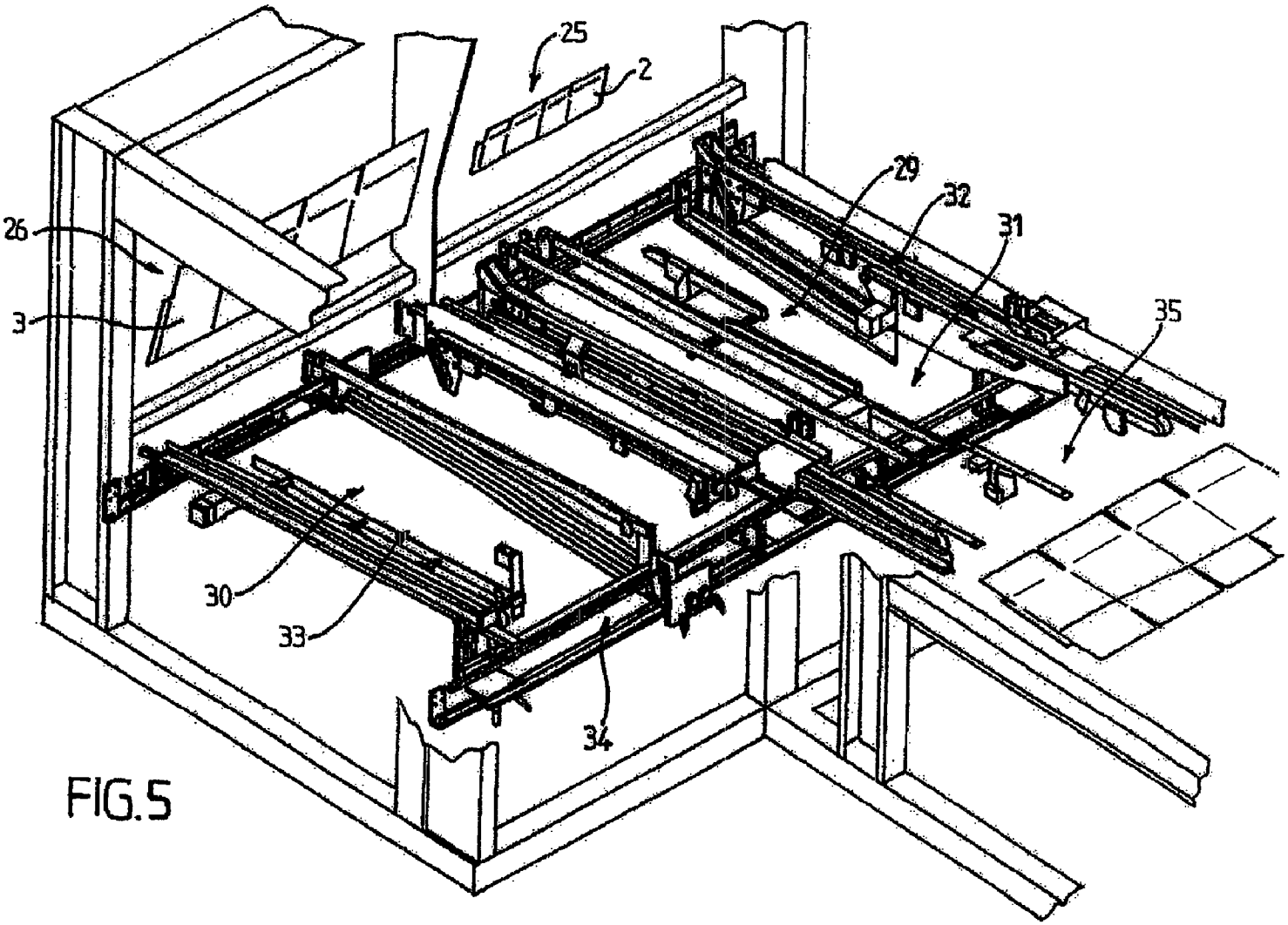
FIG. 5 is a view in perspective of two transfer tracks according to the embodiment of the device of FIG. 2.

The latter comprises two adjacent magazines 25 and 26 at an angle, known per se (cf. FIG. 5) respectively for storing first blanks 2 and second blanks 3.

Means 27, 28 for picking up a blank from said magazines by suction cup of the "flip-flop" type are provided to feed the two parallel horizontal tracks 29, 30 for transferring the blanks flat to an assembly station 31, namely a first track 29 for the first blank and a second track 30 for the second blank, each track comprising a system 32, 33 with stoppers for driving the blanks as will be described more precisely below.

The device comprises means 34, 35 of longitudinal abutment at the assembly station for each of the first and second blanks in their respective position, formed by retractable stoppers activated by an electric cylinder, between a low position situated beneath the plane of the track and a high abutment position, means (see FIG. 6) for coating the first blank with adhesive during its transfer, comprising nozzles 37 for applying hotmelt glue downward, fed by insulated pipes 38 mounted on a carriage 39 that is adjustable on the x and y axes.

The device (cf. FIG. 3) moreover comprises guide rails 40, 41, 42, 43, respectively for the blanks 2 and during their transfer, on the tracks 29, 30, and means 44 for wedging in lateral abutment the first blank 2 and for the second blank (not shown) in order to give them an exact lateral reference position against a respective reference guide rail (40 or 42).

The wedging means 44 will be described more precisely below.

The device also comprises means 50 for picking up and laterally transferring by suction cup 51 the second blank 3 in order to place it on the first blank 2 thus previously indexed, which will for their part be specified below with reference to FIG. 7.

The device 24 also comprises (cf. FIG. 4) retraction means 60 and (cf. FIG. 8) means 70 for pressing the first blank onto the second blank.

Finally, it comprises (cf. also FIGS. 9 and 10) means 80 for transferring the set of blanks thus formed to a forming station 90.

Figure 3B:
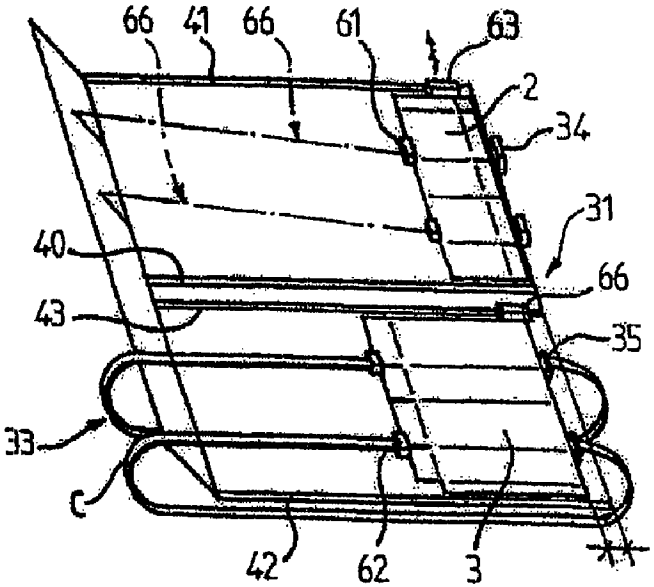
FIGS. 3A and 3B show the transfer tracks of the first and second blanks in plan and in perspective.
Figure 4:
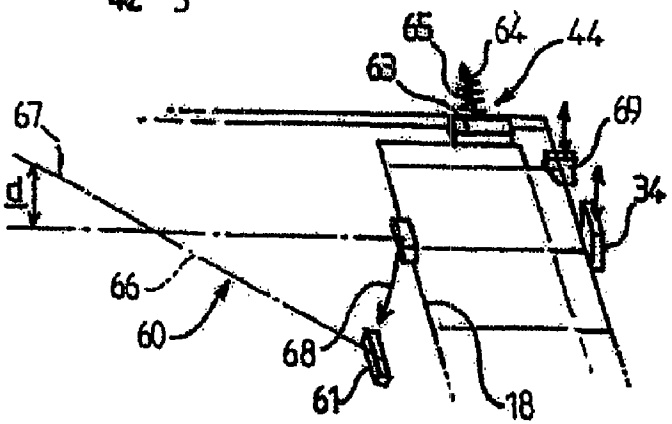
FIG. 4 shows more particularly adjustment and wedging means used with the system of transfer stoppers according to the embodiment of the invention of FIG. 3, for the first track.
Figure 3A:
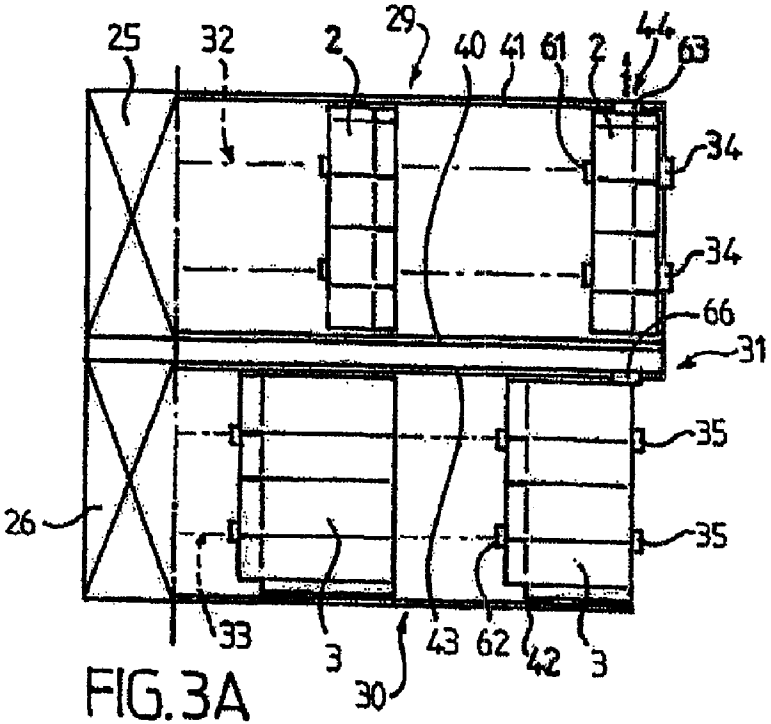

FIGS. 3, 3B and 4 show more precisely, although schematically, the upstream portion of the device according to the embodiment of the invention that is more particularly described here.

The latter comprises two adjacent magazines for storing blanks 25 and 26 and the two parallel tracks 29 and 30 for transferring the first blank 2 and the second blank 3 to the actual assembly station 31.

The tracks 29 and 30 are two parallel tracks comprising means for picking up and moving the blanks via the drive systems 32, 33 comprising endless C belts, for example actuated by a stepper motor to which are attached in a manner that can be adjusted in distance stoppers 61 for the first blanks and 62 for the second blanks which allow the movement of said blanks by pushing them between the guide rails 40, 41 for the first blanks and 42, 43 for the second blanks.

These guiding actions are carried out in a conventional manner, with a slight clearance due to the tolerances in manufacture of the blanks notably associated with the risk of warping and/or with the variations in ambient temperatures and humidity causing deformations of the cardboard.

The device 24 according to the embodiment of the invention more particularly described here comprises, at the end of the two tracks 29, 30, the longitudinal abutment means 34 and 35 which will allow a precise longitudinal reference position of the two blanks.

The latter are previously adjusted notably by the distances of the stoppers 61, 62 on the endless belts for moving the blanks.

The longitudinal wedging means 44 comprise, for their part, a stopper 63 that can move in the plane of the track 29 the travel of which will be adjusted by means of an electric cylinder in order to apply a flexible pressure to the edge of the cardboard 64, by virtue, for example, of a pressure spring 65. The means 44 make it possible to give an exact lateral reference position to the first blank 2.

Advantageously, similar means 66 for wedging the second blank may also be provided in order to position it exactly relative to its reference rail 42.

The stoppers 63 and 66 are for example also retractable downward in order to subsequently make the lifting of the blanks easier.

According to the embodiment of the invention more particularly described here, the downward retraction of the stoppers 61 is also provided when the second blank will be brought alongside the first blank.

To do this, retraction means consist of levers 66 which will pivot about a shaft 67 parallel to the plane of the transfer tracks placed above said planes (cf. FIG. 4), for example at a distance d. This allows (cf. arrow 68) the stoppers to retract without risking catching the edge 18 of the flong 2 of the first blank before being brought alongside.

Also provided is a stopper 69 with a shape beveled toward the blank, actuated by an electric cylinder, which will descend with a slight time lag relative to the rising of the longitudinal immobilization stopper 34, in order to make it possible to immobilize the blank when the stoppers 61 retract, in order to prevent any backward movement of the blank, the exact position of which would risk being out of tune before the precise placement of the second blank on the first blank.

Figure 6:
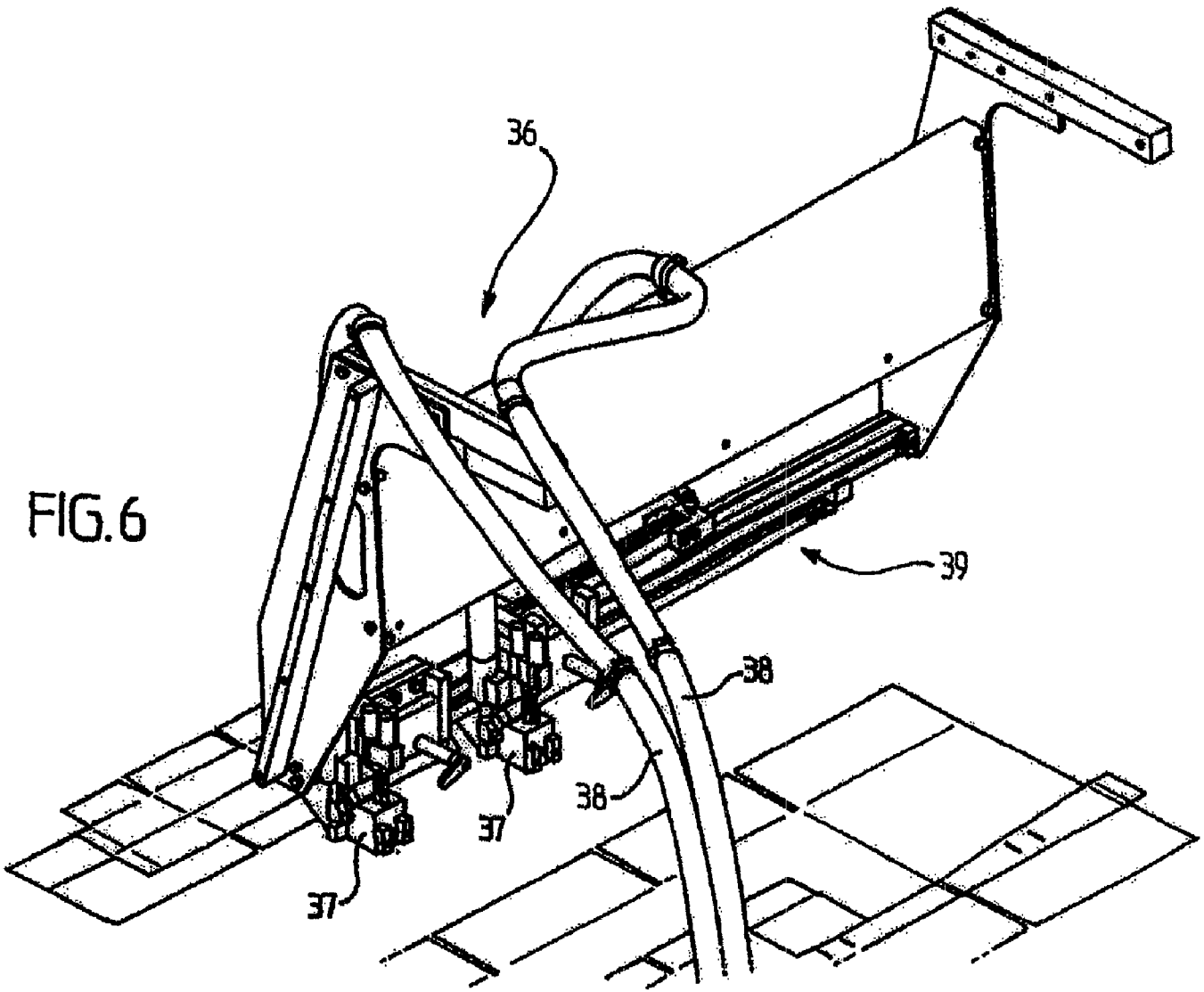
FIG. 6 is a view in perspective of the adhesive coating means allowing one blank to be attached to the other with a device according to one embodiment of the invention.

FIG. 6 shows the adhesive-coating means 36 used in a device according to the invention, known per se. These adhesive-coating means, by means of nozzles 37, allow the spraying of jets of glue over the sections 13 and 15, and on the tabs 8 and 17, of the first and second blanks for example in the form of lines as shown in FIG. 1.

Figure 7:
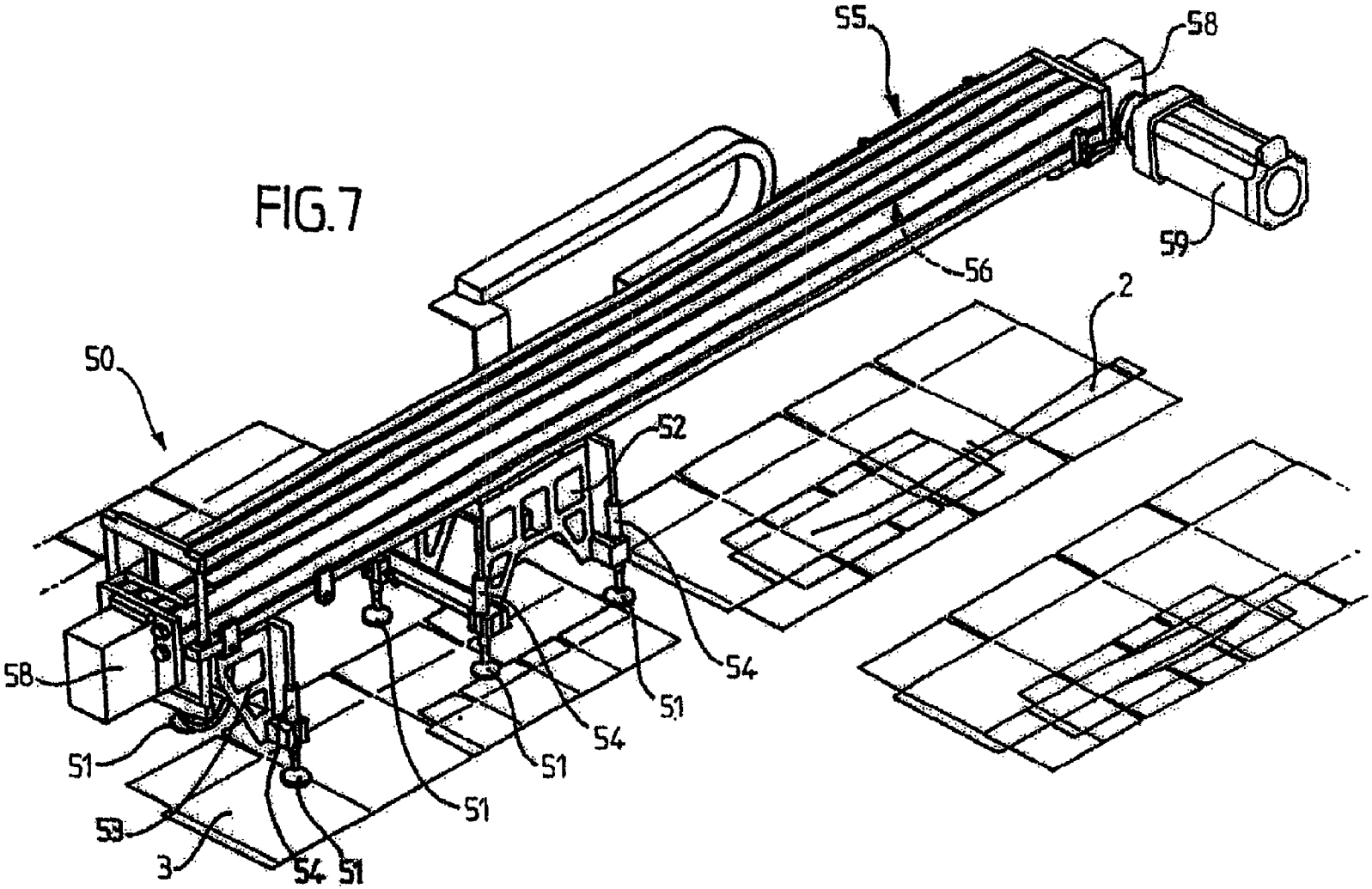
FIG. 7 is a view in perspective of the carriage for transferring the second blank to the first blank in order to form the set of blanks used with the invention.

A precise device makes it possible to position the lines of glue by adjusting the sprayers according to the size of the blanks, the machine naturally being able to be modulated to handle first and second blanks of fairly different dimension, and to do so down to very small sizes (cf. FIG. 7).

Shown in this figure and more precisely are the means 50 for transferring the second blank to the first blank.

The means 50 comprise two carriages, namely a first carriage 52 comprising four suction cups 51 secured to one another, and a second carriage 53 that can be adjusted in distance relative to the first carriage, comprising for its part two suction cups 51.

These two carriages will allow a large degree of adaptability in the size of the blanks that can be handled.

According to the embodiment of the invention more particularly described, the suction cups 51 are actuated vertically by cylinders 54 with a linear electric motor of the type manufactured by the Swiss company Linmot. They are delicate cylinders, very sensitive to the slightest lateral impact, but operate with great precision and speed and are very lightweight.

With the device according to the invention, and although they seemed incompatible at first sight, such cylinders have been found to operate perfectly in a surprising manner. Their use has the advantage of a possibility of very fast operation since the speeds of translation of the carriages, of between 4 m/s and 6 m/s, cause extremely powerful accelerations.

To do this, the carriages are, for example, mounted by means of a clutch-releasable machine device with spring damper on a drive system 55 comprising a belt 56 inside a casing 57, forming a supporting and guiding beam driven by pulleys 58 actuated by a motor 59 in a manner known per se.

The carriages are secured to the belt 56, for example, by the clamping of jaws secured to the train of carriages the spacing of which was previously adjusted. A spring device for actuating the clamping, known per se, allows the opening/closing operation of the jaws.

Figure 8:
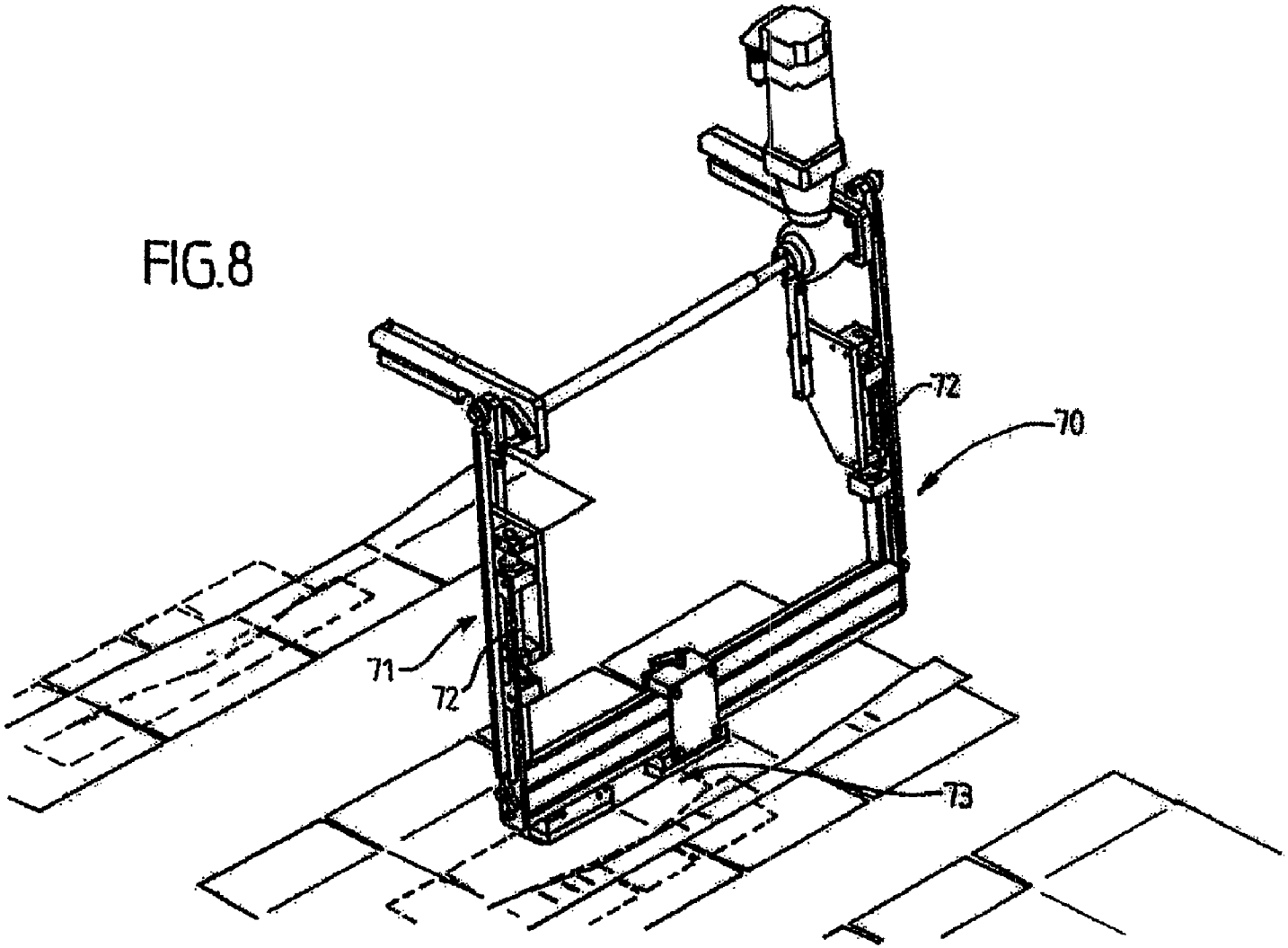
FIG. 8 is a view in perspective of the means of pressing one blank onto the other, for the gluing according to one embodiment of the invention.

FIG. 8 illustrates the means 70 for pressing the second blank onto the first blank. They comprise a system 71 with double cylinders 72 making it possible to raise and lower a pressing bar 73 of adjustable length, arranged to apply the pressure of one blank on the other, in a precise manner and allowing a good spread of the glue during the compression.

Figure 9:
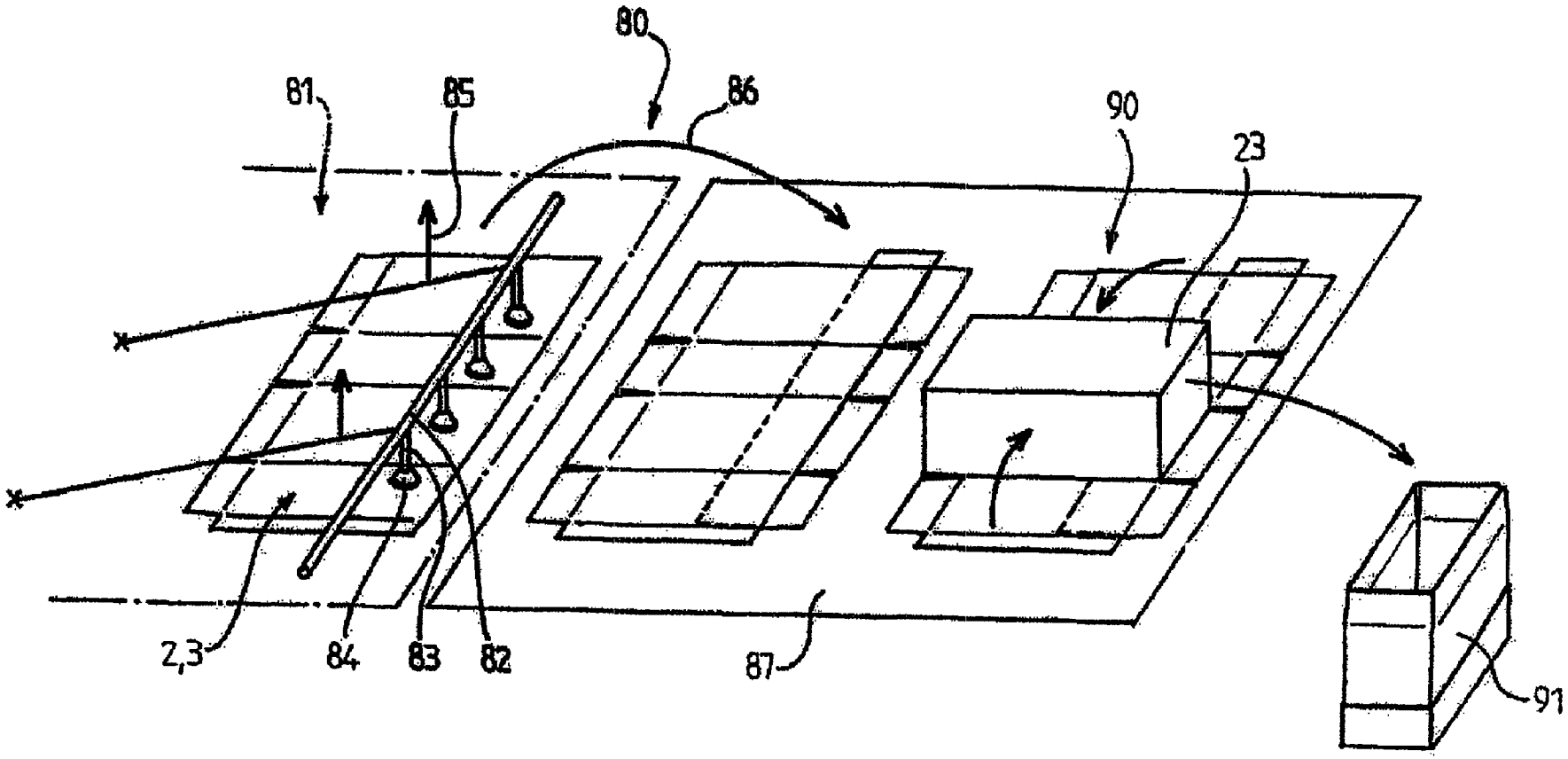
FIG. 9 is a schematic view in perspective of the device for transfer between the station for assembling the blanks and the station for forming the box around the core according to one embodiment of the invention.
Figure 10:
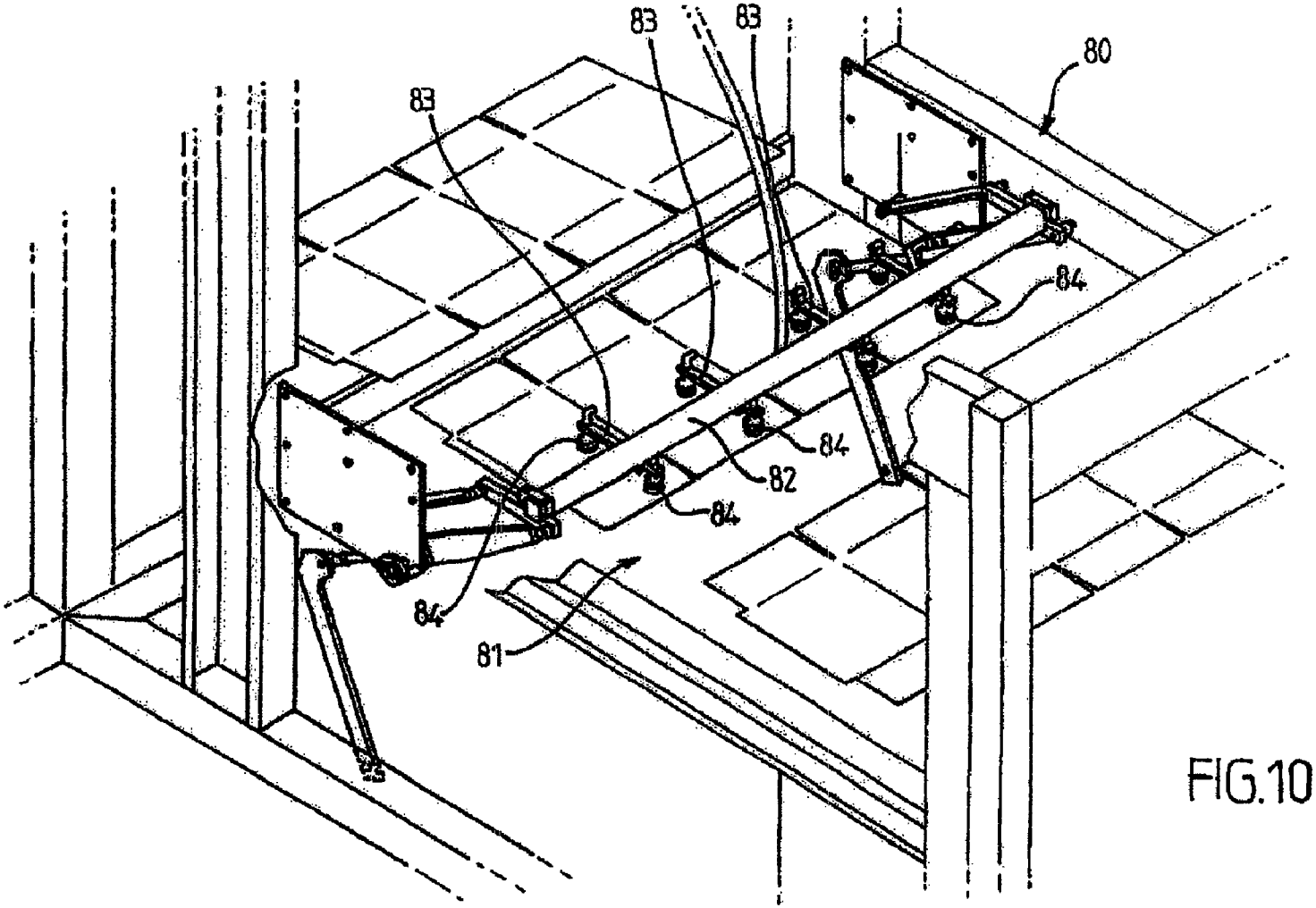
FIG. 10 shows in perspective an embodiment of the transfer between the assembly station and the forming station of the device of FIG. 2.

FIGS. 9 and 10 show, for their part, the elements of the device allowing the set of blanks thus glued to be transferred to the forming station.

More precisely, means 80 are provided for transferring the set of blanks 2 and 3 assembled as described above. The latter comprise a conveyor 81 which brings the blanks under an assembly 82 of the flip-flop type furnished with four sets 83 of two suction cups 84, the conveyor moving vertically (arrow 85) in order to come alongside the suction cups, which makes it possible to minimize their wear by friction.

The set 82 is then actuated in order to pick up the blanks and, by a translational rotary movement 86, bring them to the horizontal on the conveyor 87 for moving the set beneath the core 23.

In other words, by raising the set of blanks upward, this allows the suction cups to be brought alongside in a vertical rather than substantially horizontal manner, because of the relatively small offset in height of the assembly planes with the forming plane which otherwise would have the effect of wearing the suction cups.

The set is then brought under the core, in a manner known per se, to the forming station 90 before forming the packaging 91 as shown in FIG. 9.

According to the embodiments of the invention more particularly described here, it is advantageous to use essentially brushless motors for the actuation of the various mechanical elements.

The operation of the device will now be described with reference to FIGS. 2 and 3.

From the previously filled magazines 25, 26, the device unstacks and places on their respective track the first and second blanks which are taken over by the stoppers and moved up to their longitudinal abutment position.

The first blank is covered with adhesive during the transfer.

The blanks are then stoppered by virtue of the lateral stoppers 44 and 66 mounted elastically on springs, against their respective rails 40, 42.

Then, with the carriages 50, the second blank 3 is picked up by actuating the cylinders to the precisely-adjusted downward travel, and then the suction cups 51 are set to vacuum. Said second blank is then brought facing the first blank 2, which is lowered, by retracting the stoppers 61. The second blank is then placed precisely opposite by aligning the fold lines, the first blank being held by a stopper 69 preventing the latter from moving away again.

The suction cups are released and the carriages depart instantaneously in order to pick up the next second blank, while the bar for compression and spreading of the glue is lowered onto the blanks.

The longitudinal abutment stoppers 69 and 34 retract and release the set of blanks at the same time as the bar rises.

Then the set is brought by being pushed by the stoppers into the pick-up position on a table, which raises said set at the same time as a flip-flop pick-up bar is brought opposite.

The latter picks up the set which it then positions (cf. FIG. 9) on a transfer conveyor before the pressing beneath the core 23, known per se.

Then the box is wrapped around the core, here again in a known manner, by folding, before being ejected.

As it goes without saying and moreover as results from the foregoing, the present invention is not limited to the embodiments more particularly described. On the contrary, it embraces all the variants thereof and notably those in which the first blank is a tray.

The invention claimed is:

1. A method for producing a packaging box with a polygonal section from at least two blanks of sheet cardboard or corrugated cardboard material, namely a first blank (2) forming the bottom of said box, and a second blank (3) comprising at least four panels (4, 5, 6, 7) respectively connected together by third parallel fold lines (9), comprising a lower free edge lacking a flap on the side of the bottom, said second blank forming a cover for said box, characterized in that blanks are taken simultaneously from two adjacent magazines (25, 26) and said blanks (2, 3) are placed on two parallel tracks (29, 30), namely a first track (29) for the first blank and a second track (30) for the second blank, said blanks are transferred flat to said tracks by being guided substantially with a lateral clearance between two rails (40, 41; 42, 43) by a stopper-drive system, until they butt longitudinally at an assembly station, in a determined longitudinal position for each of the blanks, said first blank (2) is glued during its transfer to the longitudinal abutment position (34, 35), the first and second blanks are wedged in lateral abutment respectively in order to be given an exact lateral reference position, the second blank (3) is picked up, transferred laterally and placed on the first blank (2) thus indexed, by escaping the stoppers (61) of the first track when the second blank is placed beside the first, while being held by vertical-pressure immobilization, the second blank is then pressed onto the first blank in order to glue them together in their determined respective longitudinal positions, and then the assembly of blanks thus formed is transferred to a forming station (90) where the box is formed by rolling the blanks around a core.

2. The method as claimed in claim 1, characterized in that, in order to escape the stoppers (61) of the first track (29), the first blank (2) is raised above said stoppers.

3. The method as claimed in claim 1, characterized in that, in order to escape the stoppers (61) of the first track, said stoppers are retracted downward.

4. The method as claimed in claim 3, characterized in that, in order to retract the stoppers, the latter are pivoted about a shaft (67) situated above the plane of the first track, which allows a release without catching the cardboard.

5. The method as claimed in claim 1, characterized in that the vertical-pressure immobilization is carried out by means of a stopper (63) beveled toward the blanks which is actuated vertically.

6. The method as claimed in claim 1, characterized in that the second blank (3) is brought onto the first blank by transverse translation, after being picked up by suction cups (51) actuated vertically by linear electric motor cylinders, at a speed of translation of between 4 m/s and 6 m/s.

7. The method as claimed in claim 6, characterized in that the second blank (3) is transferred to the first blank (2) by an assembly of two carriages (52, 53) actuated by a belt-clamping drive system.

8. The method as claimed in claim 1, characterized in that, in order to transfer the set of blanks thus formed to the forming station, said set is lifted in order to bring it into contact with pick-up suction cups (84) of an assembly for transferring the set to the forming station.

9. The method as claimed in claim 1, characterized in that, the first blank (2) comprising a series of at least four main sections (12, 13, 14, 15) terminated by a fastening tab (17), said sections being connected together by first fold lines (16) that are parallel with one another, said series of sections forming the outer walls of the base of the box, comprising on one side an upper free edge (18) lacking flaps and being connected on the other side to a series of flaps by second fold lines (20) perpendicular to said first fold lines, the second blank (3) is placed on the first blank by aligning or by substantially aligning the free edge (11) of said second blank with the second fold lines (20) of the first blank and by superposing the third fold lines (9) relative to the first fold lines (16) of the first blank.

10. The method as claimed in claim 1, characterized in that, the first blank (2) comprising a central panel and four lateral peripheral flaps, one of said flaps, previously covered with adhesive, is placed facing a section of the second blank in order to form, once folded around the core, a tray-shaped bottom.

11. A device (24) for producing a polygonal-section packaging box from at least two blanks (2, 3) made of sheet cardboard or corrugated cardboard material, namely a first blank (2) forming the bottom of said box, and a second blank (3) comprising at least four panels (4, 5, 6, 7) connected together by third parallel fold lines (9), comprising a lower free edge (11) lacking a flap on the side of the bottom, said second blank forming a cover for said box, characterized in that it comprises two adjacent storage magazines (25, 26) respectively of the first and second blanks, means for transferring said blanks to an assembly station comprising:

means (27, 28) for picking up the blanks from said magazines, two parallel tracks (29, 30) for transferring flat said blanks to an assembly station (31), namely a first track (29) for the first blank (2) and a second track (30) for the second blank (3), each track comprising a stopper-drive system (32, 33) for the blanks, means for guiding each of said blanks, each comprising two rails (40, 41; 42, 43) for guiding the blanks (2, 3) substantially with a lateral clearance up to the assembly station, and means (34, 35) for longitudinal abutment at said assembly station, in a determined longitudinal position for each of the blanks, means (36) for coating the first blank with adhesive during its transfer to its longitudinal position, means (44) for wedging in lateral abutment the first and second blanks in order to give them a respective exact lateral reference position against one of the rails, means (50) for pick-up and lateral transfer by suction cups (51) of the second blank (3) in order to place it on the first blank (2) thus indexed, in their determined respective longitudinal positions, means (60) for escaping from the stoppers of the first track relative to the first blank, when the second blank is placed beside the first, and means for vertical-pressure immobilization of said first blank during the escape, means for pressing (70) the second blank onto the first blank, and means (80) for transferring the set of blanks thus formed to a forming station (90).

12. The device as claimed in claim 11, characterized in that it also comprises said forming station (90) comprising a core (23) and means for rolling the blanks around said core in order to form the box.

13. The device as claimed in claim 11, characterized in that the vertical-pressure immobilization means comprise a stopper (69) beveled toward the blanks which is actuated by a cylinder.

14. The device as claimed in claim 11, characterized in that the means (60) for achieving the escape from the stoppers (61) comprise means for retracting the stoppers downward by pivoting of the latter about a shaft (67) situated above the plane of the first track.

15. The device as claimed in claim 11, characterized in that the means (50) for picking up and transferring the second blank (3) onto the first blank comprise transverse translation means comprising pick-up means by suction cups (51) actuated vertically by cylinders (54) with a linear electric motor, at a speed of translation of between 4 m/s and 6 m/s.

16. The device as claimed in claim 15, characterized in that the means (50) for transferring the second blank (3) onto the first blank (2) comprise an assembly of two carriages (52, 53) actuated by a belt-clamping drive system (55, 56).

17. The device as claimed in claim 11, characterized in that the means (50) for transferring the set of blanks (2, 3) to the forming station (90) comprise an assembly for the movement of said blanks to the forming station furnished with pick-up suction cups (61) and means arranged to lift said set in order to bring it into contact with said pick-up suction cups.

18. The device as claimed in claim 11, characterized in that, the first blank (2) comprising a series of at least four main sections (12, 13, 14, 15) terminated by a fastening tab (17), said sections being connected together by first fold lines (16) parallel with one another, said series of sections forming the outer walls of the base of the box and being connected on one side to a series of flaps by second fold lines perpendicular to said first fold lines, the pick-up and transfer means are arranged in order to place the third fold lines of the second blank substantially in line with the first fold lines of the first blank, and in that the means for pressing the second blank onto the first are arranged in order to glue the two panels to the two facing nonadjacent sections.

* * * * *

UNITED STATES PATENT AND TRADEMARK OFFICE

CERTIFICATE OF CORRECTION

PATENT NO. : 8,409,064 B2
APPLICATION NO. : 12/865791
DATED : April 2, 2013
INVENTOR(S) : Desertot et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 463 days.

Signed and Sealed this
First Day of September, 2015

Michelle K. Lee

Michelle K. Lee
*Director of the United States Patent and Trademark Office*